US005095800A

United States Patent [19]

Matsuda

[11] Patent Number: 5,095,800

[45] Date of Patent: Mar. 17, 1992

[54] CHANNEL ASSIGNING SYSTEM FOR USE IN AN ELECTRONIC MUSICAL INSTRUMENT

[75] Inventor: Toshinori Matsuda, Sizuoka, Japan

[73] Assignee: Kawai Musical Inst. Mfg. Co., Ltd., Sizuoka, Japan

[21] Appl. No.: 616,182

[22] Filed: Nov. 20, 1990

[30] Foreign Application Priority Data

Nov. 24, 1989 [JP] Japan ..... 1-305818

[51] Int. Cl.[5] ..... G10H 1/22

[52] U.S. Cl. ..... 84/618; 84/DIG. 2

[58] Field of Search ..... 84/618, 656, 684, 742, 84/DIG. 2

[56] References Cited

U.S. PATENT DOCUMENTS 4,703,680 11/1987 Wachi et al. ..... 84/DIG. 2

4,984,497 1/1991 Inagaki et al. ..... 84/DIG. 2

*Primary Examiner*—Stanley J. Witkowski

[57] ABSTRACT

A channel assigning system which divides musical tone generating channels into a plurality of channel division areas and assigns musical tone generating channels of each channel division area to musical tones, in an ascending order of a value of a weighting factor corresponding to each musical tone generating channel, by searching for a musical tone channel corresponding to the smallest value of the weighting factor. Alternatively, the channel assigning system assigns musical tones in a descending order of a value of a weighting factor corresponding to each musical tone generating channel, by searching for a musical tone channel corresponding to the largest value of the weighting factor. Therefore, even if a performance is effected by quickly sounding musical tones in succession, and musical tone generating channels of a channel division area are assigned to the musical tones one after another, a performance of musical tones corresponding to musical tone generating channels of another channel division area is not affected and a radiation of musical tones is not stopped while a corresponding key is being pressed down.

19 Claims, 10 Drawing Sheets

FIG. 10 A (A) KEY NO. 30 (ON) ⟶ CH. NO. 1

| | | | | | |
|---|---|---|---|---|---|
| 1 CH | ON | L | 30 | 59 | |
| | OFF | L | — | 0 | |
| | OFF | L | — | 0 | |
| | OFF | U | — | 0 | |
| | OFF | U | — | 0 | |
| | OFF | U | — | 0 | |
| | OFF | U | — | 0 | |
| 8 CH | OFF | U | — | 0 | (SP PT : 30) |

(B) KEY NOS. 35 & 40 (ON)
⟶ CH. NOS. 2 & 3

| | | | | | |
|---|---|---|---|---|---|
| 1 CH | ON | L | 30 | 57 | |
| | ON | L | 40 | 48 | |
| | ON | L | 35 | 54 | |
| | OFF | U | — | 0 | |
| | OFF | U | — | 0 | |
| | OFF | U | — | 0 | |
| | OFF | U | — | 0 | |
| 8 CH | OFF | U | — | 0 | (SP PT : 40) |

(C) KEY NO. 45 (ON)
⟶ CH. NO. 4

| | | | | | |
|---|---|---|---|---|---|
| 1 CH | ON | L | 30 | 56 | |
| | ON | L | 40 | 47 | |
| | ON | L | 35 | 53 | |
| | ON | U | 45 | 44 | |
| | OFF | U | — | 0 | |
| | OFF | U | — | 0 | |
| | OFF | U | — | 0 | |
| 8 CH | OFF | U | — | 0 | (SP PT : 40) |

(D) KEY NO. 32 (ON) ⟶ CH. NO. 5
CH. NO. 2 : L ⟶ U

| | | | | | |
|---|---|---|---|---|---|
| 1 CH | ON | L | 30 | 55 | |
| | ON | U | 40 | 46 | |
| | ON | L | 35 | 52 | |
| | ON | U | 45 | 43 | |
| | ON | L | 32 | 57 | |
| | OFF | U | — | 0 | |
| | OFF | U | — | 0 | |
| 8 CH | OFF | U | — | 0 | (SP PT : 35) |

FIG. 10 B (E) KEY NOS. 50, 55, 60 (ON)
→ CH. NOS. 6, 7 & 8

| | | | | |
|---|---|---|---|---|
| 1 CH. | ON | L | 30 | 52 |
| | ON | U | 40 | 43 |
| | ON | L | 35 | 49 |
| | ON | U | 45 | 40 |
| | ON | L | 32 | 54 |
| | ON | U | 50 | 37 |
| | ON | U | 60 | 28 |
| 8 CH. | ON | U | 55 | 34 |

(SP PT : 35)

(F) KEY NO. 38 (ON) → CH. NO. 7

| | | | | |
|---|---|---|---|---|
| 1 CH. | ON | L | 30 | 51 |
| | ON | U | 40 | 42 |
| | ON | L | 35 | 48 |
| | ON | U | 45 | 39 |
| | ON | L | 32 | 53 |
| | ON | U | 50 | 36 |
| | ON | U | 38 | 51 |
| 8 CH. | ON | U | 55 | 33 |

(G) KEY NO. 28 (ON) → CH. NO. 3

| | | | | |
|---|---|---|---|---|
| 1 CH. | ON | L | 30 | 50 |
| | ON | U | 40 | 41 |
| | ON | L | 28 | 61 |
| | ON | U | 45 | 38 |
| | ON | L | 32 | 52 |
| | ON | U | 50 | 35 |
| | ON | U | 38 | 50 |
| 8 CH. | ON | U | 55 | 32 |

(SP PT : 32)

SP PT : SPLIT POINT

CHANNEL ASSIGNING SYSTEM FOR USE IN AN ELECTRONIC MUSICAL INSTRUMENT

BACKGROUND OF THE INVENTION

1. Field of the Invention

This invention generally relates to a channel assigning system for use in an electronic musical instrument, and more particularly, to an improved system for deciding a priority for assigning a channel to a musical tone.

2. Description of the Related Art

A process (hereunder referred to as a first conventional process) of assigning a musical tone generating channel (hereunder sometimes referred to simply as a channel) to a musical tone to be effected by a conventional channel assigning system for use in an electronic musical instrument will be first described hereinbelow. For example, in the case of an electronic keyboard instrument, when all channels are in an ON state and a key of the electronic keyboard instrument is pressed down, a channel is assigned to a musical tone corresponding to the pressed key in the following manner.

First, the current loudness levels of envelopes of musical tones corresponding to channels are compared, in a search for a channel corresponding to a musical tone having an envelope which has the smallest current loudness level, and the channel discovered by the search to correspond to a musical tone having an envelope which has the smallest current loudness level, is assigned to a musical tone corresponding to the pressed key.

Further, another process of assigning a channel to a musical tone (hereunder referred to as a second conventional process) is employed in the conventional channel assigning system. In the second conventional process, weighting factor data representing a priority for assigning a channel to a musical tone corresponding to each key is prestored in the system, and further, weighting factor data corresponding to the pressed key is read out simultaneously with the assignment of a channel to a musical tone corresponding to the pressed key, and is stored as data corresponding to the assigned channel. Then, a value indicated by the weighting factor data corresponding to the assigned channel is reduced with time, and accordingly, when a key is newly pressed down, a channel corresponding to weighting factor data having the smallest value is assigned to a musical tone corresponding to the newly pressed key.

Problems arise with the above described processes, however, when the electronic musical instrument is played. For example, where a melody is performed by quickly and successively operating keys in a high frequency range while an accompaniment chord is being played on keys in a low frequency range and a damper pedal is used, the accompaniment chord composed of musical tones in the low frequency range is drowned out by musical tones in the high frequency range corresponding to the melody. This is annoying to the listeners, and further, prevents the player from showing a proper level of skill when performing a piece of music.

Note, the second conventional process can alleviate the above problem to some extent by extending the sounding of the chord composed of musical tones in the low frequency range for a slightly longer time, in comparison with the first conventional process, but cannot completely eliminate the problem.

The present invention has been created to solve the problems of the conventional systems.

Accordingly, an object of the present invention is to provide a channel assigning system for use in an electronic musical instrument in which, while musical tones in a certain frequency range are being quickly performed, a radiation of musical tones in another frequency range corresponding to keys which are pressed is not stopped, whereby a natural and skilled performance can be achieved.

SUMMARY OF THE INVENTION

To achieve the foregoing object, in accordance with a first aspect of the present invention, there is provided a channel assigning system for use in an electronic musical instrument which comprises an number of musical tone generating channels which is equal to a largest number of musical tones which can be sounded simultaneously; a weighting factor data outputting means for outputting weighting factor data indicating a weighting factor which represents a priority of an assignment of one of the musical tone generating channels to newly indicated a musical tone and has a value which is varied according to a pitch of the newly indicated musical tone; a weighting factor data storing means for storing the weighting factor data output from the weighting factor data outputting means according to an assignment of a musical tone generating channel to the newly indicated musical tone; a weighting factor data changing means for reducing a value, indicated by the weighting factor data stored in said weighting factor data storing means, over a lapse of time; a dividing means for dividing the musical tone generating channels into a plurality of division areas, a decision means for selecting one of the division areas to which a musical tone generating channel to be assigned to the newly indicated musical tone belongs; a search means for searching for musical tone generating channels belonging to the division area selected by the decision means for a musical tone generating channel corresponding to weighting factor data; and an assignment means for assigning the musical tone generating channel, discovered through the search by the search means, to the newly indicated musical tone.

Further, in accordance with a second aspect of the present invention, there is provided a channel assigning system for use in an electronic musical instrument, which comprises a number of musical tone generating channels which is equal to the largest number of musical tones which can be sounded simultaneously; a weighting factor data outputting means for outputting weighting factor data which represents a priority of an assignment of one of the musical tone generating channels to a newly indicated musical tone and has a value which is varied according to a pitch of the newly indicated musical tone; a weighting factor data storing means for storing the weighting factor data output from the weighting factor data outputting means according to an assignment of a musical tone generating channel to the newly indicated musical tone; a weighting factor data changing means for reducing a value indicated by the weighting factor data stored in the weighting factor data storing means, over a lapse of time; a decision means for selecting one of the musical tone generating channels which is not radiating a musical tone (hereunder sometimes referred to as OFF-channels); a search means for searching for musical tone generating channels selected by the decision means for a musical tone generating channel corresponding to weighting factor data indicating the smallest value thereof; and an assignment means for assigning the musical tone generating channel, discovered through the search by the search means, to the newly indicated musical tone.

Furthermore, in accordance with a third aspect of the present invention, there is provided a channel assigning system for use in an electronic musical instrument which comprises a number of musical tone generating channels which is equal to the largest number of musical tones which can be sounded simultaneously; a weighting factor data outputting means for outputting weighting factor data which represents a priority of an assignment of one of the musical tone generating channels to a newly indicated musical tone and has a value which is varied according to a pitch of the newly indicated musical tone; a weighting factor data storing means for storing the weighting factor data output from the weighting factor data outputting means according to an assignment of a musical tone generating channel to the newly indicated musical tone; a weighting factor data changing means for reducing a value indicated by the weighting factor data stored in the weighting factor data storing means, over a lapse of time; a decision means for selecting one of the musical tone generating channels which is not radiating a musical tone; a search means for searching for musical tone generating channels selected by the decision means for a musical tone generating channel corresponding to weighting factor data indicating the largest value thereof; and an assignment means for assigning the musical tone generating channel, discovered through the search by said search means, to the newly indicated musical tone.

Therefore, even when musical tones in a certain frequency range are being quickly performed, a radiation of musical tones in another frequency range corresponding to keys which are pressed is not stopped, whereby a natural and skilled performance can be achieved.

BRIEF DESCRIPTION OF THE DRAWINGS

Other features, objects and advantages of the present invention will become apparent from the following description of a preferred embodiment with reference to the drawings in which like reference characters designate like or corresponding parts throughout several views, and in which:

FIGS. 10A and 10B is a diagram illustrating a practical example of a channel assignment process.

DESCRIPTION OF THE PREFERRED EMBODIMENT

Hereinafter, a preferred embodiment of the present invention will be described in detail, with reference to the accompanying drawings.

As illustrated in FIGS. 10A and 10B (A)~(E), an off-channel channel is assigned to a musical tone each time a KEY ON operation of a key (i.e., an operation of turning ON one voice by pressing down a key) is effected, as will be described later (see steps S21~S24 of FIG. 6, steps S31~S37 of FIG. 7 and steps S03, S04 and S09 of FIG. 5). Note, a channel corresponding to the smallest value of a weighting factor is assigned to a musical tone, as will be described later (see steps S32~S34 of FIG. 7).

Further, as shown in FIG. 10B (F) and (G), when a KEY ON operation is effected of a key corresponding to a musical tone, to which a channel of an upper channel area (to be described later) or a lower channel area (to be described later) is assigned, a channel corresponding to a weighting factor indicating the smallest value is selected from channels of the same channel area (see steps S44, S45~S47) and is assigned to the musical tone corresponding to the key, as will be described later (see steps S05~S07 and S09 of FIG. 5).

Figure 3:
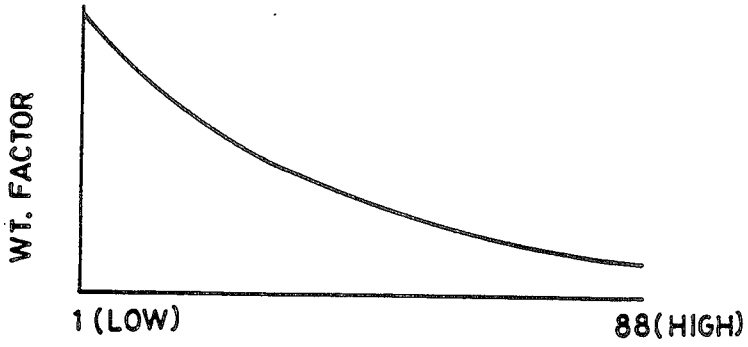
FIG. 3 is a graph illustrating the contents of weighting factor data stored in a read only memory (ROM) 10 of the electronic musical instrument of FIG. 1.
Figure 5:
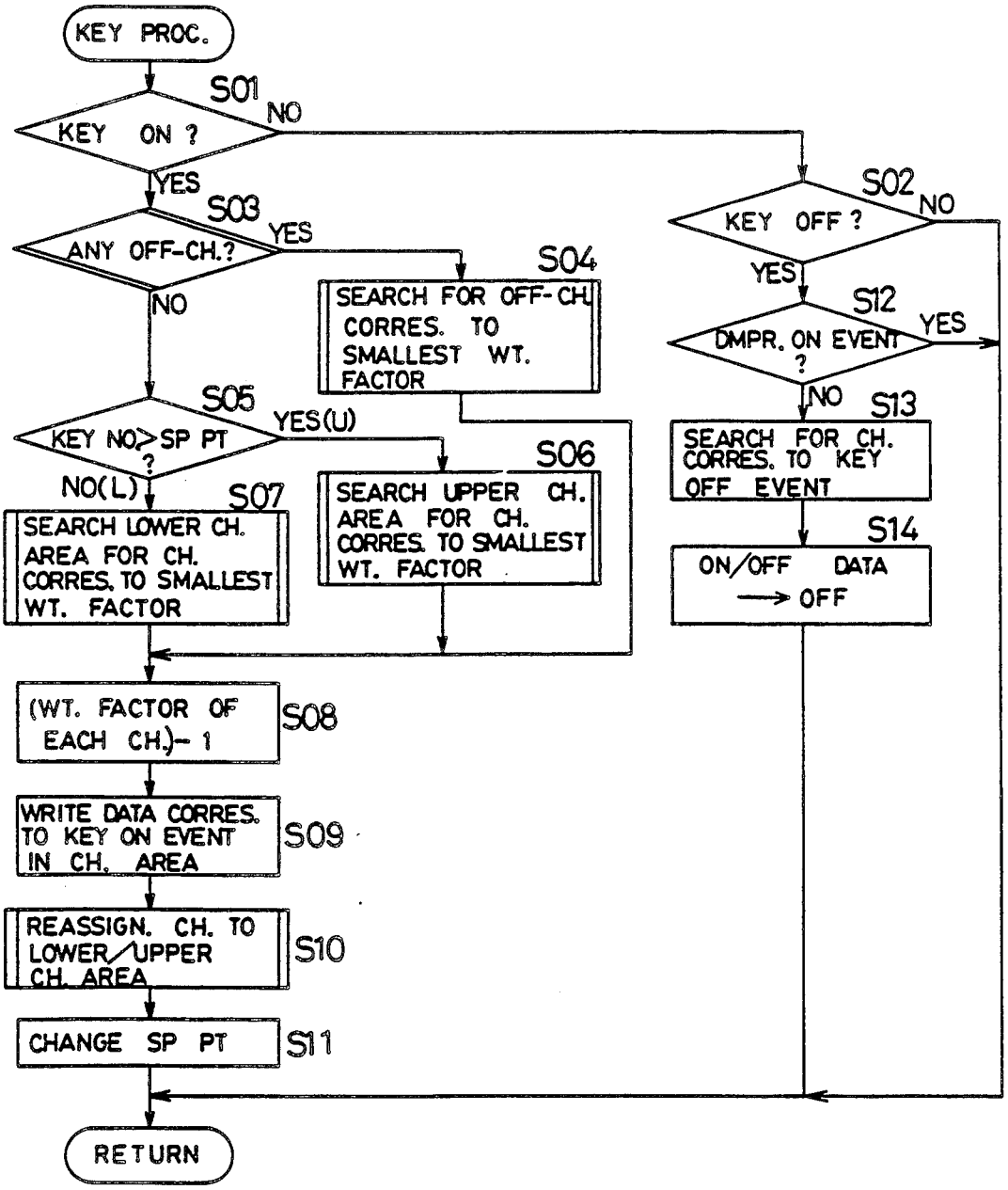
FIG. 5 is a flowchart of a program for effecting a key process.
Figure 9A:
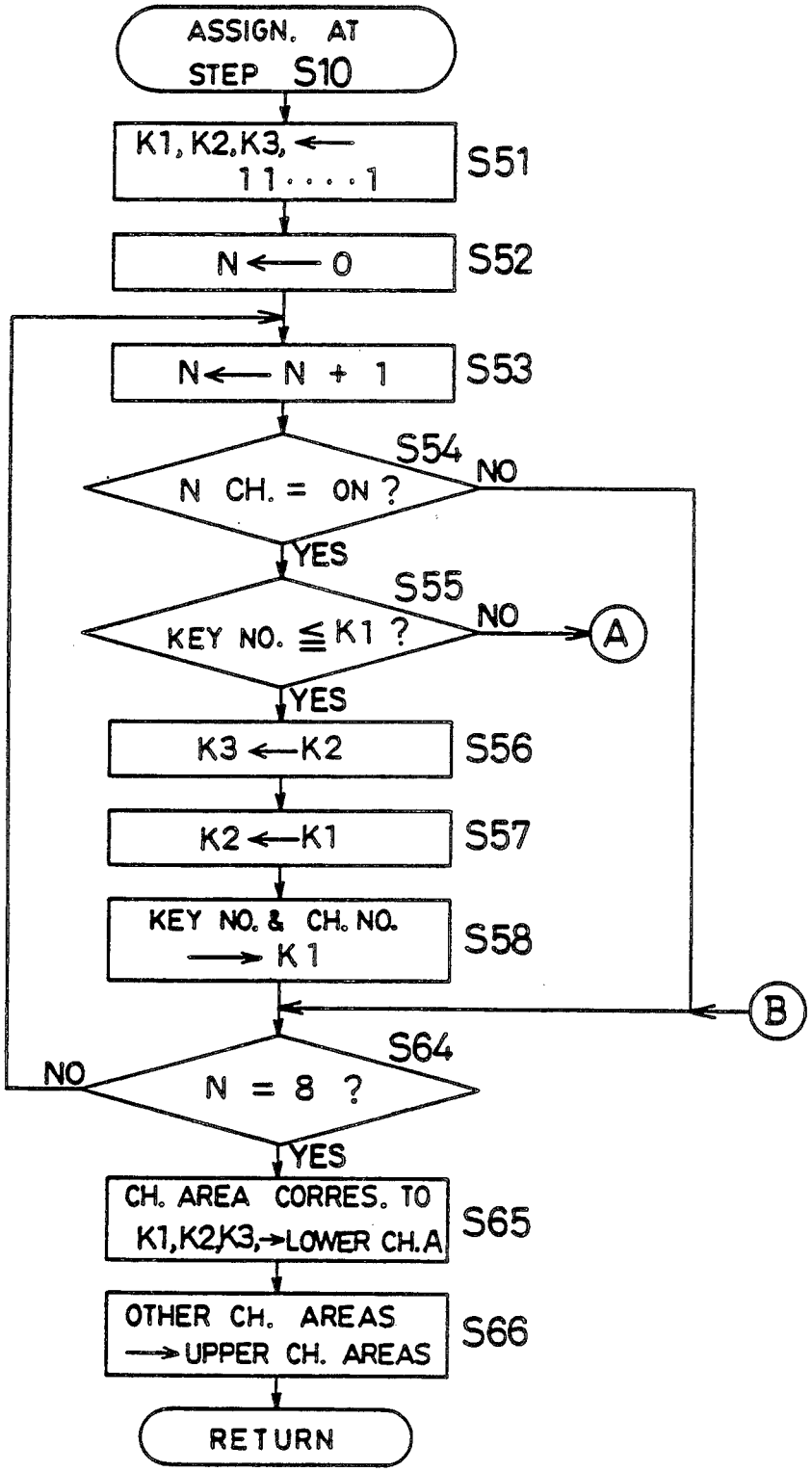
FIGS. 9A and 9B is a flowchart of a program for effecting an upper and lower channel area reassignment process.

When a channel is newly assigned to a musical tone, in this embodiment a search is made for channels assigned to musical tones corresponding respectively to the first, second, and third lowest pitches (see steps S55~S63 of FIGS. 9A and 9B), and then the channels are reassigned to the lower channel area and the upper channel area (see steps S10~S11 of FIG. 5 and steps S65 and S66 of FIG. 9A). Note, as illustrated in FIG. 3, the higher the pitch of the musical tone to which a channel should be newly assigned becomes, the smaller becomes a value indicated by the weighting factor data. Further, the value indicated by the weighting factor data is reduced by 1 each time a KEY ON operation is effected (see step S08 of FIG. 5). Accordingly, the higher a pitch of a musical tone to which a channel has already been assigned becomes, and further, the earlier the channel is assigned to the musical tone, the easier a reassignment of the channel to the musical tone to which a channel should be newly assigned can be effected.

1. ARRANGEMENT OF ENTIRE ELECTRONIC MUSICAL INSTRUMENT

Figure 1:
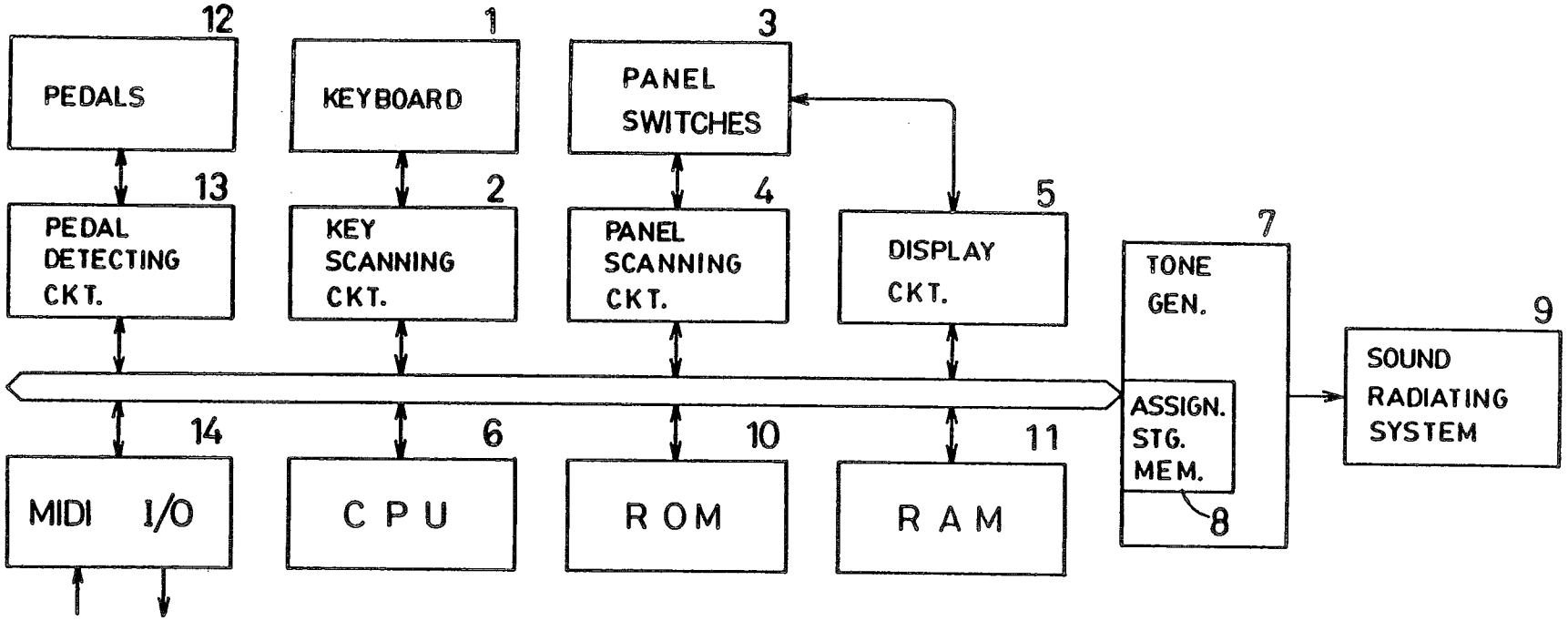
FIG. 1 is an entire circuit diagram of an electronic instrument employing a channel assigning system according to the present invention.
Figure 2:
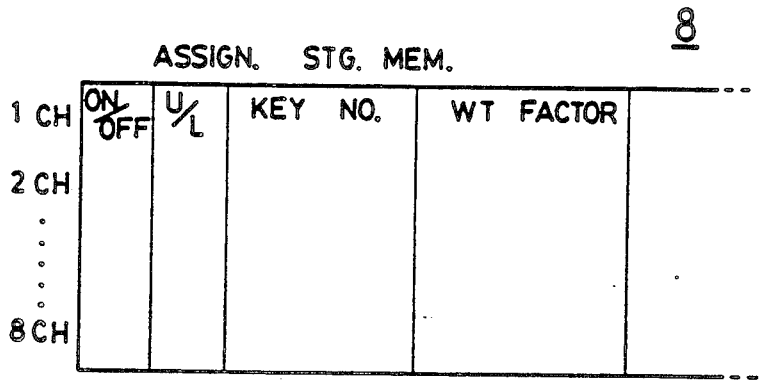
FIG. 2 is a diagram showing a part of the contents of an assignment storing memory 8 of the electronic musical instrument of FIG. 1.

FIG. 1 is an entire circuit diagram of an electronic musical instrument provided with a channel assigning system according to the present invention. As shown in FIG. 2, a state of each key of a keyboard 1 is scanned by a key scanning circuit 2, to detect whether a KEY ON operation or a KEY OFF operation (i.e., an operation of turning off one voice by releasing a key) of each key has been effected. The results of this detection are input by a central processing unit (CPU) 6 to an assignment storing memory 8 of a tone generator 7. Further, each of the panel switches 3 is used to select a timbre, a rhythm and so on, and a state of each of the panel switches 3 is scanned by a panel scanning circuit 4. The results of this scan (i.e., data representing the selected timbre, rhythm and so on) are input by the CPU 6 to the tone generator 7. The results of this scan are input to a panel light emitting diode (LED) circuit 5, whereby the corresponding LEDs of the panel switches 3 are turned ON.

A group of pedals 12 is composed of various pedals such as a damper pedal, a sostenuto pedal, and a soft pedal, and a pedal detecting circuit 13 is used to detect an ON or OFF-state of, and an inclination of each pedal of, the group 12 and so forth. This circuit 13 is constructed to operate as follows. First, a logical sum of bits of data output by a position sensor such as a differential transformer provided on the damper pedal, and of data output by an angle sensor such as a rotary encoder, is obtained, and a leading edge and a trailing edge of a signal representing this logical sum is detected. Thereafter, a signal representing the results of the detection of the leading edge and the trailing edge is input to the CPU 6 as a damper event detection signal. Accordingly, when ever data is output from the position sensor or the angle sensor, the damper event detection signal is output from the circuit 13. Note, the circuit 13 also may operate for a muffler pedal, a mute pedal, a shift pedal and so on. Moreover, this embodiment can be applied to an electronic musical instrument to which a player can give an instruction to sound musical notes, e.g., an electronic string instrument such as an electronic guitar, an electronic brass instrument, an electronic percussion instrument and so forth, other than the keyboard 1.

Then, the tone generator 7 generates musical tone signals according to various data output by the circuits 2 and 4, and data set in the assignment storing memory 8, and thereafter, the musical tone signals are output therefrom to a sound radiating system 9 which radiates musical tone sounds in response to the musical tone signals received. Further, a read only memory (ROM) 10 stores various processing programs to be executed in the CPU 6, and weighting factor data (to be described later), and in some cases, stores musical tone waveform data and envelope waveform data. In addition, a random access memory (RAM) 11 stores data to be used in the various processes.

Further, a musical tone generating system for generating musical tones corresponding to eight channels is formed in the tone generator 7, and accordingly, musical tone data corresponding to the eight channels is stored in the assignment storing memory 8. Other musical tone data input thereto from external equipment through a MIDI (Musical Instrument Digital Interface) interface 14 can be written in the assignment storing memory 8. This write-operation is effected by the CPU 6 in the processes (to be described later) illustrated in FIGS. 5~9.

FIG. 2 shows a part of data stored in the assignment storing memory 8. As shown in this figure, in a storage area for storing data related to a channel (hereunder referred to simply as a channel area), are stored ON/-OFF data, upper/lower (U/L) data, key Nos. and weighting factor data. In addition, timbre data, frequency number data, envelope data and velocity data are also stored in a channel area. The number of channel areas of the assignment storing memory 8 may be more or less than eight. Note, the weighting factor data may be stored in a memory other than the assignment storing memory 8. Further, another format for storing the weighting factor data may be employed, as long as the weighting factor data can be stored corresponding to an assigned channel.

The ON/OFF data is 1-bit data indicating whether each key of the keyboard 1 is in an ON-state (i.e., is pressed down) or in an OFF-state (i.e., is released). Further, where a player steps on the damper pedal of the group 12, even when a key is released, the ON/OFF data does not indicate an OFF-state of the released key, and thus the ON/OFF data indicates an ON-state until the damper pedal is released. Therefore, if the same key is pressed down many times while the damper pedal is depressed, a channel is assigned to a musical tone corresponding to the same key, each time the same key is pressed down.

Next, the U/L data is data indicating a kind of channel area (hereunder sometimes referred to as a channel division area). The lower (L) data corresponds to channels assigned to musical tones to which channels have been assigned and having the first, second and third lowest pitches. The upper (U) data corresponds to channels assigned to musical tones other than the musical tones corresponding to the lower (L) data. Accordingly, if the number of musical tones to which channels should be assigned is less than or equal to three, the lower data corresponds to all of the musical tones. Further, if the number of musical tones to which channels should be assigned is equal to five, the lower data corresponds to three musical tones having lower pitches and the upper data corresponds to the remaining two musical tones having upper pitches. Hereinafter, a channel area corresponding to the lower data will be referred to as a lower channel area, and a channel area corresponding to the upper data will be referred to as an upper channel area.

When a key corresponding to a musical tone, to which a channel corresponding to an upper channel area is assigned, is in an OFF-state and a channel corresponding to a lower channel area is newly assigned to a musical tone to which a channel corresponding to a lower channel area should be assigned, a channel assigned to a musical tone having the highest pitch is changed from a channel corresponding to a lower channel area to another channel corresponding to an upper channel area. Furthermore, when a key corresponding to a musical tone, to which a channel corresponding to a lower channel area is assigned, is in an OFF-state and a channel corresponding to an upper channel area is newly assigned to a musical tone to which a channel corresponding to an upper channel area should be assigned, a channel assigned to a musical tone having the lowest pitch is changed from a channel corresponding to an upper channel area to another channel corresponding to a lower channel area.

Namely, channels corresponding to the lower and upper channel areas can be flexibly changed. Note, the allocation of channels between the lower and upper channel areas may be effected not by first allocating channels to the lower channel area but by first allocating channels to the upper channel area, and thus if the number of musical tones to which channels should be assigned is less than or equal to five, channels corresponding to the upper channel area may be assigned to all of the musical tones. Where the number of channel division areas is more than or equal to three, lower, upper and middle channel areas may be employed. Further, where the number of channel division areas is more than or equal to three, channels may be allocated to the channel division areas in any order of the channel division areas (e.g., channels are allocated to a lower channel area, an upper channel area, and a middle channel area in that order). Moreover, the number of channel division areas may be more than or equal to three. Furthermore, the upper/lower data may be omitted.

Further, the key number Nos. indicate the numbers of from 1 to 88 respectively assigned to the keys of the keyboard 1 in ascending order of pitch, and thus a key number corresponds to a pitch corresponding to a key.

FIG. 3 shows the relationship between the key Nos. and the weighting factors indicated by the weighting factor data. A weighting factor represents a priority of an assignment of a channel to a musical tone corresponding to a key. Further, weighting factors respectively corresponding to the keys have different values and are stored in the ROM 10. When a channel is newly assigned to a musical tone, one of channels corresponding to the channel division areas, which corresponds to a weighting factor having the smallest value, is selected and assigned to the musical tone. Note that the lower a pitch of a musical tone, the larger a value of a weighting factor indicated by weighting factor data corresponding to a channel to be assigned to the musical tone. Therefore, the lower a pitch of a musical tone to which a channel has already been assigned, the harder it is to newly assign the channel to another musical tone. Consequently, a radiation of the musical tone to which the channel has already been assigned is not stopped while a corresponding key is being pressed down.

Note, any weighting factor data other than that illustrated in FIG. 3 may be employed. For example, weighting factor data which indicates a large value when a pitch of a musical tone to be sounded is high, and further, indicates the smallest value when a pitch of a musical tone to be sounded is in an intermediate range thereof, may be employed. Alternatively, a weighting factor data indicating a weighting factor having a value which changes according to predetermined constant ranges of pitches of musical notes to be sounded may be employed. Further, weighting factor data having characteristics which are set in such a fashion that the smaller a value thereof, the harder it is to newly assign a channel which has already been assigned to a musical note and corresponds to the value of the weighting factor data to another musical tone may be used. In this case, the value of the weighting factor data is increased by one with time at step S08 of FIG. 5 (to be described later) and a channel already assigned to a musical tone corresponding to a weighting factor, the value of which is larger than those of weighting factors corresponding to musical tones to which other channels have been assigned, is newly assigned to another musical tone at step S33 of FIG. 7 and at step S46 of FIG. 8 as will be described later.

Moreover, the weighting factor data may be computed from the key Nos. instead of being prestored in the ROM 10. Assuming that values 88~1 of the weighting factors respectively correspond to key Nos. 1~88, a weighting factor may be given by:

$$(\text{a value of a weighting factor}) = 89 - (\text{a key No.})$$

Further, a value of a weighting factor may be obtained by the following set of equations:

$$(\text{a value of a weighting factor}) \times (\text{a key No.}) = A$$

-continued $$(\text{the value of a weighting factor}) = ((\text{the key No.}) - B)^2 + C$$

where characters A, B and C denote constants. These equations are computed in a program stored in the ROM 10, at step S09 of FIG. 5 (to be described later).

Further, an operation (e.g., an addition) may be performed on weighting factor data and other data (e.g., velocity data representing a speed of or a pressure used in an operation of a key or timbre data). This operation is performed at the time of writing weighting factor data, at step S09 of FIG. 5 (to be described later).

Figure 4:
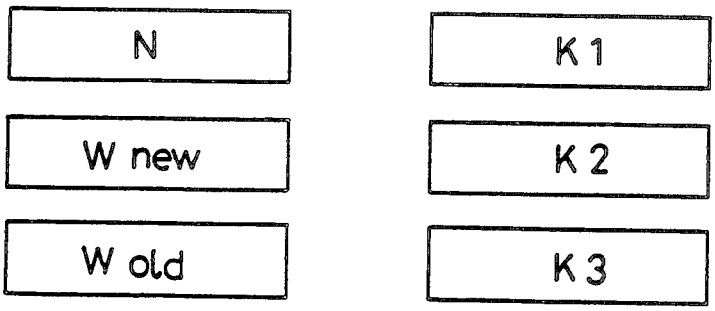
FIG. 4 is a diagram illustrating various registers of a random access memory of FIG. 1.

Referring next to FIG. 4, which shows registers of the RAM 11, a register N is used to count the number of times a search is made of channels of the assignment storing memory 8. Further, registers Wnew and Wold, in each of which a weighting factor corresponding to and a channel No. of a channel of the assignment storing memory 8 are stored, are used to search for a channel corresponding to a weighting factor of the smallest value.

Furthermore, registers K1, K2 and K3, in which key Nos. of musical tones of the first, second and third lowest pitches and channel Nos. of channels corresponding to the lower channel area of the assignment storing memory 8 are stored, are used to effect a reassignment of the upper/lower data. In the register K3, the key No. corresponding to the musical tone of a pitch which is highest among the three lowest pitches, and the channel No. of a corresponding channel, are stored, and thus information on a boundary (hereunder sometimes referred to as a split point) between the upper and lower channel areas is stored.

2. KEY PROCESS

FIG. 5 is a flowchart of a program for effecting a key process, which constitutes an entire process together with an initialization process and panel switch process. Note, the entire process is commenced by turning on the electric power supply.

In the key process, the CPU 6 first determines from the output of the key scanning circuit 2 whether a KEY ON operation or a KEY OFF operation is effected (i.e., a KEY ON event or a KEY OFF event occurs (see steps S01 and S02)). If a KEY ON event occurs, a channel assignment process is effected at steps S03~S11. In contrast, if a KEY OFF event occurs, a KEY OFF process is performed at steps S12~S14.

In the channel assignment process when a KEY ON event occurs, at step S03 the program searches the assignment storing memory 8 for a channel area (hereunder referred to an OFF-channel area) in which the ON/OFF data indicates an OFF-state. If OFF-channel areas are found, a channel corresponding to a weighting factor of the smallest value is selected from channels corresponding to the off-channel areas and the selected channel is assigned to a musical tone corresponding to a key pressed in the KEY ON operation (i.e., the KEY ON event), at step S04.

If no OFF-channel is found at step S03, at step S05 it is determined whether a key No. corresponding to the KEY ON event is equal to or greater than a key No. corresponding to the split point stored in the register K3 (i.e., a key No. corresponding to a musical tone which has the highest pitch among the musical tones corresponding to channels of the lower channel area). If the key No. is equal to or greater than the key No. corresponding to the split point, a channel corresponding to a weighting factor having the smallest value is selected from channels each corresponding to a channel area in which the upper/lower data indicates an upper state (i.e., the upper channel area) and the selected channel is assigned to the musical tone corresponding to the KEY ON event at step S06. In contrast, if the key No. is lower than the key No. corresponding to the split point, a channel corresponding to a weighting factor having the smallest value is selected from channels each corresponding to a channel area in which the upper/lower data indicates a lower state (i.e., the lower channel area) and the selected channel is assigned to the musical tone corresponding to the KEY ON event at step S07.

Then, each of the values of weighting factors corresponding to all of the channel areas of the assignment storing memory 8 is decremented by one at step S08. Further, in a channel area corresponding to the assigned channel, various data corresponding to the KEY ON event, i.e., the ON/OFF data indicating an ON-state, the key No. and the weighting factor data read from the ROM 10 and corresponding to the key No. and so on, are written at step S09. The process of decrementing one from the weighting factors may be effected by interrupting the CPU at regular intervals. Note, as long as the values of the weighting factors can be reduced with time, any other operation (e.g., a multiplication, a division and an addition and so forth) may be employed as the process of reducing the values of the weighting factors.

Next, at step S10, a reassignment of channels to the lower and upper channel areas is performed in such a manner that channels corresponding to musical tones of the first, second and third lowest pitches are assigned to the lower channel area and the other channels are assigned to the upper channel area, and accordingly, the information on the split point, which is stored in the register K3, is changed at step S11.

If it is determined at step S02 that a KEY OFF event has occurred, it is determined at step S12 whether or not the pedal detecting circuit 13 has output a DAMPER ON event signal showing that the damper pedal is depressed. If the DAMPER ON event signal is not output, a search is made for a channel area in which a key No. of a key corresponding to the KEY OFF event is set, at step S13. Then, the ON/OFF data stored in the searched for channel area is cleared, and data indicating an OFF-state is stored in this channel area at step S14.

Further, if it is found at step S12 that the DAMPER ON event signal has been output, the processes to be effected at steps S13 and S14 (hereunder sometimes referred to as the KEY OFF process) is not carried out and the instrument continues sounding the musical tones. If the damper pedal has been released and a DAMPER OFF event signal indicating that the damper pedal has been released is output, the KEY OFF process is effected by interrupting the CPU as follows. Namely, if a state of the ON/OFF data stored in each channel area of the assignment storing memory 8 is not in agreement with the results of the scan effected by the key scanning circuit 2, the state of the ON/OFF data is changed from an ON-state to an OFF-state.

3. OFF-CHANNEL AREA SEARCH

Figure 6:
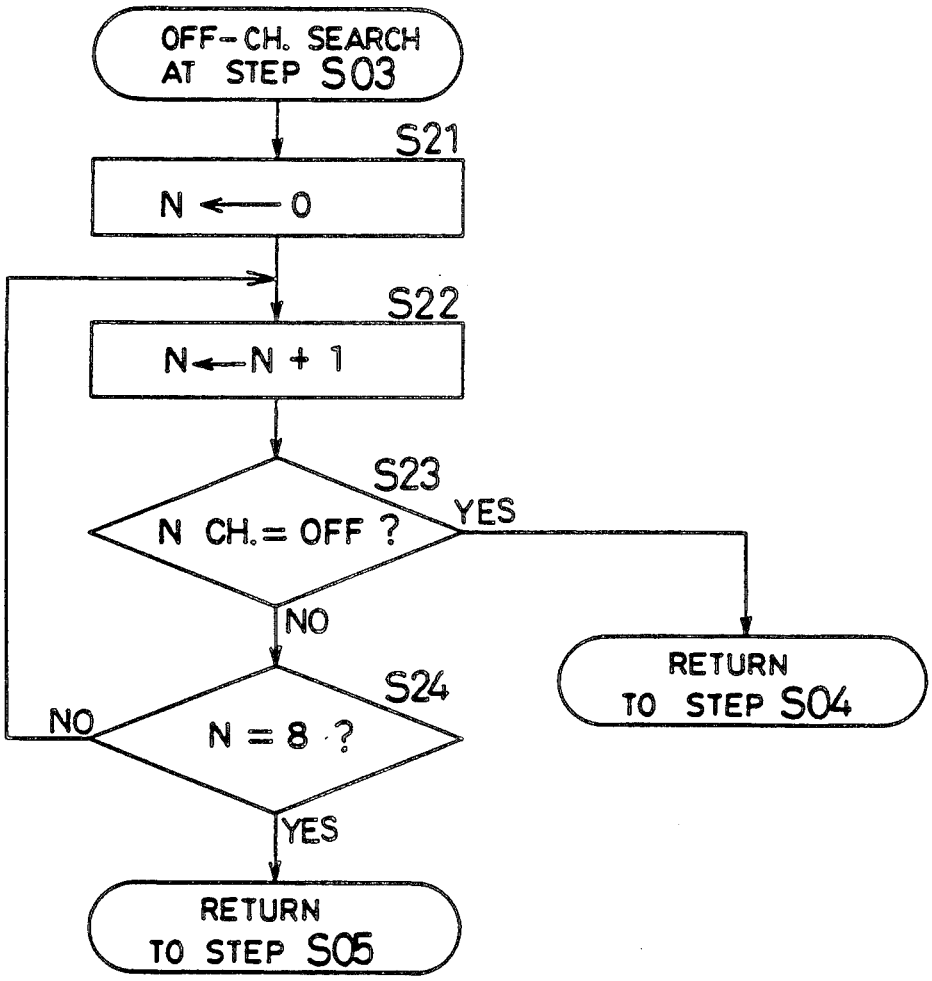
FIG. 6 is a flowchart of a program for effecting an OFF-channel area search process.

FIG. 6 is a flowchart of a program for effecting an OFF-channel area search process of step S03 of FIG. 5.

In this process, the register N is first cleared at step S21, and subsequently at step S22, 1 is added to a value indicated by the register N. Then, it is determined at step S23 whether or not ON/OFF data stored in a channel area of the assignment storing memory corresponding to the value indicated by the register N indicates an OFF-state. If the ON/OFF data does not indicate an OFF-state, the search process of steps S22 and S23 of this figure is performed at step S24 until the value indicated by the register N reaches 8 (i.e., the search process is performed on all of the channels).

If an OFF-channel area is found at step S23, the program advances to step S04, but if no OFF-channel area is found as a result of the search of all of the channels, the program advances to step S05.

4. PROCESS OF SEARCHING FOR AN OFF-CHANNEL CORRESPONDING TO A WEIGHTING FACTOR HAVING THE SMALLEST VALUE

Figure 7:
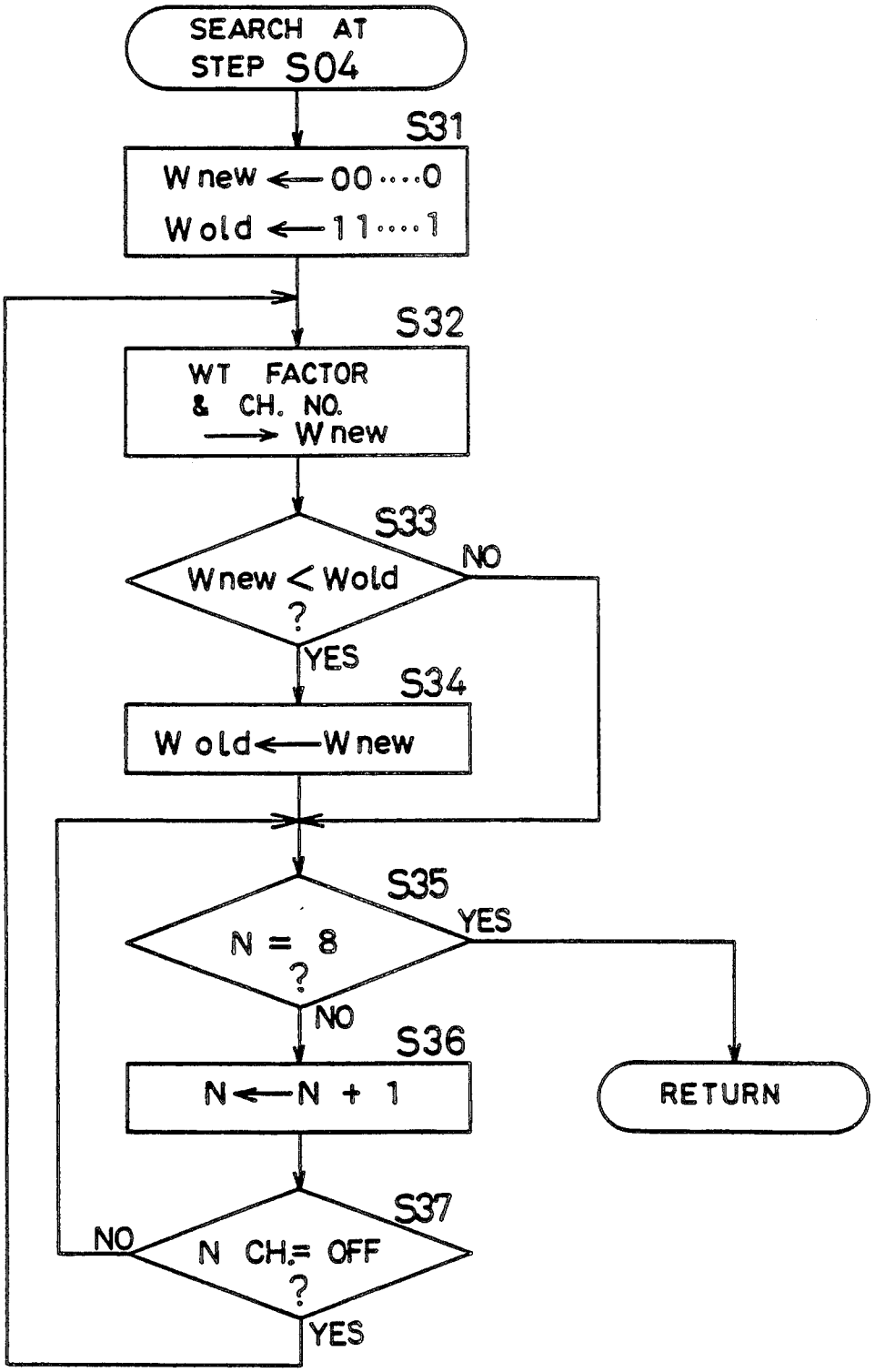
FIG. 7 is a flowchart of a program for effecting the smallest weighting factor data search process.

FIG. 7 is a flowchart of a program for effecting a process of a search for an OFF-channel corresponding to the weighting factor having the smallest value (see step S04 of FIG. 5).

In this process, the CPU 6 first clears the register Wnew and sets a maximum value 11—1 in the register Wold at step S31. Then, the weighting factor data corresponding to the OFF-channel area searched for at step S23 of FIG. 6 is read out, and further, the weighting factor indicated by the read weighting factor data is set in the register Wnew together with a channel No. of a corresponding channel, at step S32. If it is found at step S33 that the weighting factor set in the register Wnew is less than that set in the register Wold, the weighting factor set in the register Wnew is transferred to the register Wold at step S34, and thus a channel No. of a channel corresponding to a weighting factor having the smallest value, and a weighting factor data indicating this weighting factor, are searched for by effecting the processes of steps S33 and S34.

Furthermore, this search process is performed on OFF-channel areas at step S37, by increasing the value indicated by the register N by 1 at step S36 until the value indicated by the register N reaches 8 (i.e., the search process is performed on all of the channels at step S35). If an OFF-channel corresponding to a weighting factor having the smallest value is found, as a result of the search of all of the OFF-channels, the program advances to step S08 of FIG. 5.

Figure 8:
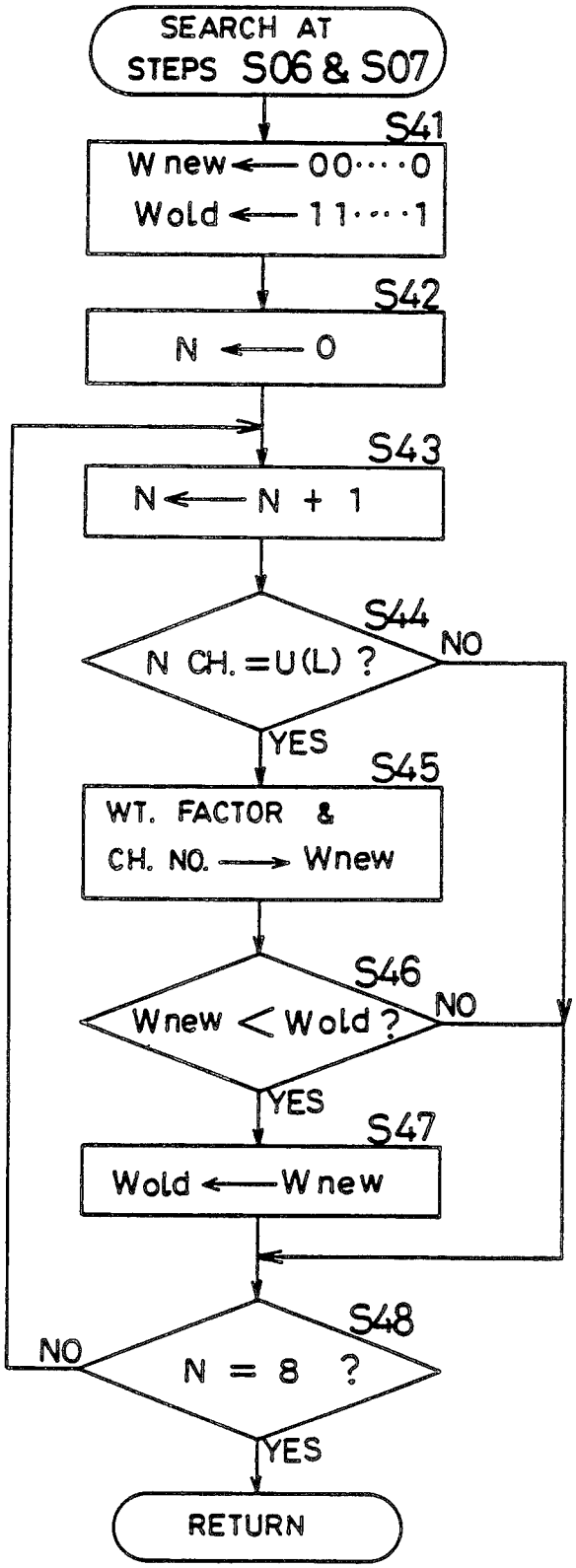
FIG. 8 is a flowchart of a program for effecting a process (to be described later) of a search of upper (or lower) channel areas of OFF-channel areas for the smallest weighting factor data.

Note, this search process may be performed in a manner similar to that of FIG. 8.

5. PROCESS OF SEARCHING AN UPPER (LOWER) CHANNEL AREA FOR AN ON-CHANNEL CORRESPONDING TO A WEIGHTING FACTOR HAVING THE SMALLEST VALUE

FIG. 8 is a flowchart of a program for effecting a process of a search for an upper or lower channel area for a channel which is in an ON-state and radiating a musical tone (hereunder sometimes referred to as an ON-channel) corresponding to the weighting factor having the smallest value (see step S06 of FIG. 5).

In this process, the CPU 6 first clears the register Wnew and sets a maximum value 11—1 in the register Wold at step S41, and then the register N is cleared at step S42. Thereafter, a value indicated by the register N is incremented by 1 at step S43. Further, it is determined at step S44 whether or not the upper/lower data stored in a channel area, which corresponds to the value indicated by the register N, of the assignment storing memory 8, indicates the upper channel area. If the upper channel area is indicated, weighting factor data stored in the channel area, which corresponds to the value indicated by the register N, of the assignment storing memory 8, is read out, and further, a weighting factor indicated by the read weighting factor data is set in the register Wnew at step S45 together with a channel No. of a channel corresponding to the channel area.

Further, if it is found at step S46 that the weighting factor set in the register Wnew is less than the weighting factor set in the register Wold, the weighting factor set in the register Wnew is transferred to the register Wold at step S47, and thus the channel No. of a channel which corresponds to the weighting factor having the smallest value of the upper channel area and the weighting factor having the smallest value are searched for by effecting the processes of steps S46 and S47.

Subsequently, this search process is repeatedly performed on channels of only the upper channel area at step S44, until the value indicated by the register N reaches 8 (i.e., the search process is performed on all of the channels of the upper channel area at step S48). If an off-channel corresponding to a weighting factor having the smallest value is found, as a result of the search of all of the channels of the upper channel area, the program advances to step S08 of FIG. 5.

Note, a similar search process is performed at step S07 of FIG. 7 as the process of searching a lower channel area for an ON-channel corresponding to the weighting factor having the smallest value, with the exception that it is determined at step S44 whether or not the upper/lower data indicates the lower channel area.

6. UPPER AND LOWER CHANNEL REASSIGNMENT PROCESS

Figure 9B:
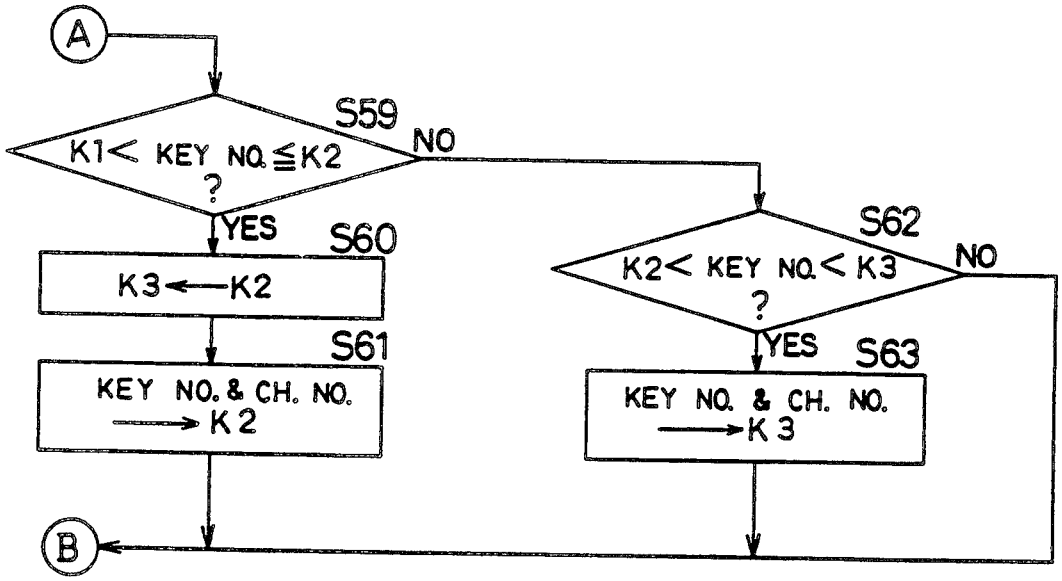

FIGS. 9A and 9B is a flowchart of a program for effecting an upper and lower channel area reassignment process of step S10 of FIG. 5.

In this process, the CPU 6 first sets the maximum value 11—1 in the registers K1, K2 and K3 at step S51. Then, at step S52, the register N is cleared, and thereafter, a value indicated by the register N is incremented by 1 at step S53. Further, it is determined at step S54 whether or not ON/OFF data stored in a channel area, which corresponds to the value indicated by the register N, of the assignment storing memory 8 indicates an ON-state. If an ON-state is indicated, channel Nos. of channels which should be assigned to musical tones having the first, second and third lowest pitches, and thus should be allocated to the lower channel area, and key Nos. of keys corresponding to the musical tones having the first, second and third lowest pitches, are searched for as follows.

In this process of a search for the channel Nos. and the key Nos., first it is determined at step S55 whether or not a key No. (hereunder referred to as the key No. in question) of a key corresponding to a musical tone to which a channel corresponding to the value indicated by the register N is equal to or lower than the key No. set in the register K1. Further, it is determined at step S59 whether or not the key No. in question is equal to or lower than the key No. set in the register K2. Furthermore, it is determined at step S62 whether or not the key No. in question is equal to or lower than the key No. set in the register K3. If it is found at step S55 that the key No. in question is equal to or lower than the key No. set in the register K1, the key No. and the channel No. set in the register K2 are transferred to the register K3 at step S56, and then the key No. and the channel No. set in the register K1 are transferred to the register K2 at step S57. Subsequently, the key No. in question and a channel No. of a corresponding channel are set in the register K1 at step S58.

Further, if it is found at step S59 that the key No. in question is higher than the key No. set in the register K1 and is equal to or lower than the key No. set in the register K2, the key No. and the channel No. set in the register K2 are transferred to the register K3, and moreover, the key No. in question and the channel No. of the corresponding channel are set in the register K2 at step S61. Furthermore, if it is found at step S62 that the key No. in question is higher than the key No. set in the register K2 and is equal to or lower than the key No. set in the register K3, the key No. in question and the channel No. of the corresponding channel are set in the register K3 at step S63.

As a consequence of this searching of the channels of the assignment storing memory 8, a key No. of a key corresponding to the musical tone, the pitch of which is lowest among those of musical tones to which the channels already searched are assigned, and a channel No. of a channel corresponding to the musical tone having the lowest pitch, are set in the register K1. Further, a key No. of a key corresponding to the musical tone, the pitch of which is second lowest among those of musical tones to which the channels already searched are assigned, and a channel No. of a channel corresponding to the musical tone having the second lowest pitch, are set in the register K2. Furthermore, a key No. of a key corresponding to the musical tone, the pitch of which is third lowest among those of musical tones to which the channels already searched are assigned, and a channel No. of a channel corresponding to the musical tone having the third lowest pitch, are set in the register K3.

Subsequently, this search process is repeatedly performed on only ON-channels, at step S54, until the value indicated by the register N reaches 8 (i.e., the search process is performed on all of the ON-channels at step S64). If key Nos. of keys corresponding to musical tones, the pitches of which are first, second and third lowest among those of musical tones to which the channels already searched are assigned, and channel Nos. of channels corresponding to the key Nos. are found as a result of the search of all of the channels, lower data is set in channel areas corresponding to the channels assigned to the musical tones, the pitches of which are first, second and third lowest, at step S65, to form a lower channel area. Further, at step S66, upper data is set in the other channel areas to form an upper channel area.

At that time, if the number of keys being pressed down is equal to or less than two, the channel No. set in the register K3 or K2 is the maximum value 11—1. Note, no channel has such a channel No, and therefore, such a channel No. is excluded from channel Nos. of channels of the lower channel area. Then, the program advances to step S11. In this case, the key No. set in the register K3 indicates the split point. Note, the lowest pitch of musical tones to which channels of the upper channel area are assigned may be employed as data indicating the split point.

Note, where the keys of the keyboard 1 are divided into more than two regions, for example, where a key corresponding to a first musical tone having a low pitch is allocated to a first key region, two keys respectively corresponding to second and third musical tones having pitches higher than the pitch of the first musical tone are allocated to a second key region, and five keys respectively corresponding to fourth to eighth musical tones having pitches higher than the pitches of the first, second and third musical tones are allocated to a third key region, then at steps S65 and S66, key region data indicating the first key region is set in a channel area corresponding to a channel assigned to the first musical tone, which corresponds to a key having the key No. set in the register K1, to form a first key region channel area, and key region data indicating the second key region is set in each of the channel areas corresponding to channels respectively assigned to the second and third musical tones, which correspond to keys having the key Nos. set in the register K2 and K3, to form a second key region channel area, and key region data indicating the third key region is set in each of the channel areas corresponding to channels respectively assigned to the fourth to eighth musical tones to form a third key region channel area. In this case, the key No. set in the register K1 and the key No. set in the register K3 indicate the split points. Obviously, the key No. set in the register K2 and the key No. of a key corresponding to a musical tone, the pitch of which is lowest among those of the fourth to eighth musical tones corresponding to the third key region channel area, may be employed as data indicating the split points.

Further, where the keys of the keyboard 1 are divided into n regions (n is a positive integer greater than 3), then registers K1, K2, K3—for (n−1) key regions are provided in the system, and further, channels which are assigned to musical tones corresponding to the (n−1) key regions are searched from the channel corresponding to the musical tone having the lowest pitch, as at steps S55~S58, S59~S61 and S62~S63, and thereafter, an assignment of channels to the first to third key regions is effected, i.e., the key region data is set in the searched for channel areas and the first to third key region channel areas are formed as at steps S65~S66. Note, obviously such an assignment of channels to the key regions may be effected by searching the channels from a channel corresponding to a musical tone having a high pitch to a channel corresponding to a musical tone having a low pitch.

7. A PRACTICAL EXAMPLE OF PROCESS OF ASSIGNING CHANNELS TO MUSICAL TONES

FIGS. 10A and 10B (A)~(G) are diagrams illustrating a practical example of a process of assigning channels to musical tones.

(1) Stage (A) (See FIG. 10A (A))

First, when a key having the key No. 30 is pressed down, the processes of steps S01, S03, S04, S08~S11 are effected. Further, ON/OFF data indicating an ON-state, upper data, the key No. 30, and weighting factor data indicating a weighting factor having a value of 59, are set in Channel Area No. 1 (1CH). This weighting factor data corresponding to the key No. 30 is read from the ROM 10. When channel areas of the assignment storing memory 8 are cleared, weighting factor data of each of the cleared channel areas is 00—0. Then, at steps S33 and S34, the channel No. is not cleared but remains a channel No. of a leading one of the cleared channels. Note where cleared channels exist, the channels are newly assigned to musical tones in an ascending order of channel Nos.

(2) Stage (B) (See FIG. 10A (B))

Next, when keys having the key Nos. 35 and 40 are pressed down, the processes of steps S01, S03, S04 and S08~S11 are repeated twice, and thus ON/OFF data indicating an ON-state, lower data, a key No. 40, and weighting factor data indicating a weighting factor having a value of 49, are set in Channel Area No. 2 (2CH). Further, ON/OFF data indicating an ON-state, lower data, a key No. 35 and weighting factor data indicating a weighting factor having a value of 54, are set in Channel Area No. 3 (3CH). In this case, when the key No. 40 is set in Channel Area No. 2 (2CH), the value 59 of the weighting factor corresponding to the key No. 30 stored in Channel Area No. 1 (1CH) is decremented by 1 at step S08, so that the value of the weighting factor corresponding to the key No. 30 becomes 58. Furthermore, when the key No. 35 is set in Channel Area No. 3, the value 58 of the weighting factor corresponding to the key No. 30 stored in Channel Area No. 1 (1CH) and the value 49 of the weighting factor corresponding to the key No. 40 stored in Channel Area No. 1 are decremented by 1 at step S08, so that the value of the weighting factor corresponding to the key No. 30 and that of the weighting factor corresponding to the key No. 40 becomes 57 and 48, respectively. Note, the number of the keys pressed down at this stage is equal to or less than three, and thus the assigned channels belong to the lower channel area.

(3) Stage (C) (See FIG. 10A (C))

Then, when a key having the key No. 45 is pressed down, upper data is set in Channel Area No. 4 (4CH) because this key No. 45 has a higher number than the key Nos. 30, 35 and 40 of the keys already pressed down. In this case also, the value of each of the weighting factors corresponding to the assigned channel areas is decremented by 1 at step 08.

(4) Stage (D) (See FIG. 10A (D))

When a key having the key No. 32 is further pressed down, the process of changing the upper/lower data of step S10, of FIG. 9 is effected because the key No. 32 has a lower number than the key No. 40 corresponding to the split point. Accordingly, the channels corresponding to the key Nos. 30, 32 and 35 belong to the lower channel area, and the channels corresponding to the key Nos. 40 and 45 belong to the upper channel area.

(5) Stage (E) (See FIG. 10B (E))

Subsequently, when keys having the key Nos. 50, 55 and 60 are pressed down, the upper/lower data of each of the channel areas corresponding to the assigned channels is not changed because these key Nos. 50, 55 and 60 are higher than the key No. 35 corresponding to the split point. Further, at this stage all channels are in an ON-state.

(6) Stage (F) (See FIG. 10B (F))

Thereafter, when a key having the key No. 38 is pressed down, the processes of steps S01, S03, S05, S06 and S08~S11 are effected because this key No. 38 is higher than the key No. 35 corresponding to the split point. Accordingly, a channel corresponding to a channel area, which stores the weighting factor data indicating a weighting factor smaller than any other weighting factors indicated by the weighting factor data stored in the channel areas of the upper channel area, (i.e., a channel corresponding to the channel area which stores the key No. 60 and the weighting factor data indicating the weighting factor 28) is newly assigned to a musical tone corresponding to the key No. 38.

(7) Stage (G) (See FIG. 10B (G))

Further, when a key having the key No. 28 is pressed down, the processes of steps S01, S03, S05, S07 and S08~S11 are effected because this key No. 28 is lower than the key No. 35 corresponding to the split point. Accordingly, a channel corresponding to a channel area which stores the weighting factor data indicating a weighting factor smaller than any other weighting factors indicated by the weighting factor data stored in the channel areas of the lower channel area, (i.e., a channel corresponding to the channel area which stores the key No. 35 and the weighting factor data indicating the weighting factor 48) is newly assigned to a musical tone corresponding to the key No. 28.

Although a preferred embodiment of the present invention has been described, it should be understood that the present invention is not limited thereto, and that other modifications will be apparent to those skilled in the art without departing from the spirit of the invention. For example, although two kinds of channel division areas, i.e., the upper and lower channel areas, are employed in the above described embodiment of the present invention, three kinds of channel division areas, i.e., upper, middle and lower channel areas, may be employed. Further, although the weighting factor indicating a priority for assigning a channel to a musical tone is made smaller as the pitch of the musical tone becomes higher (i.e., the higher the pitch of a musical tone to which a channel should be assigned, the easier it is to newly assign a channel to the musical tone) in the above described embodiment of the present invention, the weighting factor indicating a priority for assigning a channel to a musical tone may be made the smallest in a middle pitch range. Further, other kinds of weighting factor data may be employed.

The scope of the present invention, therefore, should be determined solely by the appended claims.

What is claimed is:

1. A channel assigning system for use in an electronic musical instrument, said channel assigning system comprising:

a number of musical tone generating channels which is equal to a largest number of musical tones which can be sounded simultaneously;

weighting factor data outputting means for outputting weighting factor data indicating a weighting factor which represents a priority for an assignment of one of said musical tone generating channels to a newly indicated musical tone and has a value which is varied in accordance with a pitch of the newly indicated musical tone;

weighting factor data storing means for storing the weighting factor data output from said weighting factor data outputting means in accordance with an assignment of a musical tone generating channel to the newly indicated musical tone;

weighting factor data changing means for changing a value indicated by the weighting factor data stored in said weighting factor data storing means with an elapse of time;

dividing means for dividing the musical tone generating channels into a plurality of division areas;

decision means for selecting one of the division areas to which a musical tone generating channel to be assigned to the newly indicated musical tone belongs;

search means for searching the musical tone generating channels belonging to the division area selected by said decision means, to discover a musical tone generating channel corresponding to weighting factor data; and assignment means for assigning the musical tone generating channel, discovered by the searched by said search means, to the newly indicated musical tone.

2. The channel assigning system of claim 1, wherein as the pitch of a musical tone to which a channel should be assigned becomes higher, the weighting factor becomes smaller and the assignment of a channel to the musical tone becomes easier.

3. The channel assigning system of claim 1, wherein said weighting factor data changing means changes all of the weighting factor data stored in said weighting factor data storing means each time a musical tone is newly generated.

4. The channel assigning system of claim 1, wherein said dividing means changes the division areas each time a musical tone generating channel is newly assigned to a musical tone.

5. The channel assigning system of claim 1 or 4, wherein said dividing means divides the musical tone generating channels into a first group of the musical tone generating channels assigned to musical tones having pitches which are first to nth lowest among those of the musical tones to which the musical tone generating channels have been assigned and a second group of the musical tone generating channels which have been assigned to other musical tones.

6. The channel assigning system of claim 1 or 4, wherein said dividing means divides the musical tone generating channels into a first group of the musical tone generating channels assigned to musical tones having pitches which are first to nth highest among those of the musical tones to which the musical tone generating channels have been assigned and a second group of the musical tone generating channels which have been assigned to other musical tones.

7. The channel assigning system of claim 1, wherein said weighting factor data outputting means stores the weighting factor data indicating a weighting factor which represents a priority of an assignment of one of the musical tone generating channels to a newly indicated musical tone.

8. The channel assigning system of claim 1, wherein said weighting factor data outputting means computes the weighting factor data indicating a weighting factor, which represents a priority of an assignment of one of the musical tone generating channels to a newly indicated musical tone, and outputs the computed weighting factor data.

9. The channel assigning system of claim 1, wherein said weighting factor data outputting means outputs the weighting factor data indicating a weighting factor, which represents a priority of an assignment of one of the musical tone generating channels to a newly indicated musical tone, in such a manner that the value of the weighting factor is changed in accordance with regions of the pitches of the musical tones.

10. The channel assigning system of claim 1, wherein said weighting factor data outputting means synthesizes data from data representing a state of an operation of generating a musical tone and the weighting factor data indicating a weighting factor, which represents a priority of an assignment of one of the musical tone generating channels to a newly indicated musical tone, and further, outputs the synthesized data.

11. The channel assigning system of claim 10, wherein the data representing a state of an operation of generating a musical tone is data indicating a speed of effecting an operation of generating a musical tone.

12. The channel assigning system of claim 10, wherein the data representing a state of an operation of generating a musical tone is data indicating a strength used to effect an operation of generating a musical tone.

13. The channel assigning system of claim 1, wherein said weighting factor data changing means reduces the value indicated by the weighting factor data stored in said weighting factor data storing means over an elapse of time, and said search means searches for a musical tone generating channel corresponding to weighting factor data indicating the smallest value thereof.

14. The channel assigning system of claim 1, wherein said weighting factor data changing means increases the value indicated by the weighting factor data stored in said weighting factor data storing means over an elapse of time, and said search means searches for a musical tone generating channel corresponding to weighting factor data indicating the largest value thereof.

15. The channel assigning system of claim 1 which further comprises first musical tone generation instructing means, wherein said musical tone generating channels are assigned to said first musical tone generation instructing means.

16. The channel assigning system of claim 1 which further comprises second musical tone generation instructing means connected to external equipment, wherein said musical tone generating channels are assigned to said second musical tone generation instructing means.

17. The channel assigning system of claim 1, which further comprises musical tone sounding means for sounding the musical tones to which said musical tone generating channels are assigned.

18. A channel assigning system for use in an electronic musical instrument, said channel assigning system comprising:

a number of musical tone generating channels which is equal to the largest number of musical tones which can be sounded simultaneously;

weighting factor data outputting means for outputting weighting factor data which represents a priority of an assignment of one of the musical tone generating channels to a newly indicated musical tone and has a value which is varied in accordance with a pitch of the newly indicated musical tone;

weighting factor data storing means for storing the weighting factor data output from said weighting factor data outputting means according to an assignment of a musical tone generating channel to the newly indicated musical tone;

weighting factor data changing means for reducing a value indicated by the weighting factor data stored in said weighting factor data storing means with an elapse of time;

decision means for selecting one of the musical tone generating channels which is in an OFF state for a radiation of a musical tone;

search means for searching the musical tone generating channels selected by said decision means for a musical tone generating channel corresponding to weighting factor data indicating the smallest value thereof; and assignment means for assigning the musical tone generating channel, discovered by the search by said search means, to the newly indicated musical tone.

19. A channel assigning system for use in an electronic musical instrument, said channel assigning system comprising:

a number of musical tone generating channels which is equal to the largest number of musical tones which can be sounded simultaneously;

weighting factor data outputting means for outputting weighting factor data which represents a priority of an assignment of one of the musical tone generating channels to a newly indicated musical tone and has a value which is varied in accordance with a pitch of the newly indicated musical tone;

weighting factor data storing means for storing the weighting factor data output from said weighting factor data outputting means according to an assignment of a musical tone generating channel to the newly indicated musical tone;

weighting factor data changing means for reducing a value indicated by the weighting factor data stored in said weighting factor data storing means over an elapse of time;

decision means for selecting one of the musical tone generating channels which is in an OFF state for a radiation of a musical tone;

search means for searching the musical tone generating channels selected by said decision means for a musical tone generating channel corresponding to weighting factor data indicating the largest value thereof; and assignment means for assigning the musical tone generating channel, discovered by the search by said search means, to the newly indicated musical tone.

* * * * *